US012808546B2

(12) United States Patent
Kim et al.

(10) Patent No.: US 12,808,546 B2
(45) Date of Patent: Nov. 24, 2026

(54) COOKING APPARATUS

(71) Applicant: SAMSUNG ELECTRONICS CO., LTD., Suwon-si (KR)

(72) Inventors: Sangjin Kim, Suwon-si (KR); Sangjin Lee, Suwon-si (KR); Changhoon Oh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 468 days.

(21) Appl. No.: 18/220,490

(22) Filed: Jul. 11, 2023

(65) Prior Publication Data

US 2024/0085030 A1 Mar. 14, 2024

Related U.S. Application Data

(63) Continuation of application No. PCT/KR2023/008171, filed on Jun. 14, 2023.

(30) Foreign Application Priority Data

Sep. 14, 2022 (KR) ..... 10-2022-0115946

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC ..... F24C 15/2042; F24C 15/2035
(Continued)

(56) References Cited

U.S. PATENT DOCUMENTS 2,081,640 A * 5/1937 Petersen ..... F24C 15/2042 126/299 R
3,485,229 A * 12/1969 Gilliom ..... F24C 14/02 219/400

(Continued)

FOREIGN PATENT DOCUMENTS

CN 110160102 8/2019
EP 3 380 791 B1 10/2019

(Continued)

OTHER PUBLICATIONS

Chinese to English machine translation of CN110160102.*

(Continued)

*Primary Examiner* — Michael G Hoang
*Assistant Examiner* — Elizabeth Ann Laughlin
(74) *Attorney, Agent, or Firm* — STAAS & HALSEY LLP

(57) ABSTRACT

A cooktop including an upper plate on which to place a cooking vessel, and a suction port penetrating through the upper plate in a first direction; a duct; a chamber to connect the suction port and the duct; and a blower fan connected to the duct to generate airflow so that air around the upper plate is suctioned through the suction port and then through the chamber and then guided by the duct, wherein the chamber include a chamber body includes a chamber outlet arranged in a second direction perpendicular to the first direction and configured to communicate with the duct, and an inner space formed so that air suctioned through the suction port flows through the inner space to the chamber outlet, and a guide rib arranged inside the chamber body to partition the inner space to guide the air suctioned through the suction port to the chamber outlet.

12 Claims, 8 Drawing Sheets

(58) Field of Classification Search
USPC ..... 126/299 R
See application file for complete search history.

(56) References Cited

U.S. PATENT DOCUMENTS

| | | | | |
|---|---|---|---|---|
| 4,335,705 | A * | 6/1982 | Kurotaki, Kiyomitu | F24C 15/2042 126/41 R |
| 4,648,378 | A * | 3/1987 | Nishikawa | F24C 15/2035 126/299 F |
| 4,827,903 | A * | 5/1989 | Kim | A47J 37/0682 126/41 R |
| 5,884,619 | A | 3/1999 | Terry | |
| 5,960,786 | A * | 10/1999 | Lambertson | F24C 15/2035 126/299 R |
| 6,241,809 | B1 * | 6/2001 | Hopkins | F24C 15/20 55/DIG. 36 |
| 10,712,019 | B2 | 7/2020 | Adam et al. | |
| 10,718,528 | B2 | 7/2020 | Bruckbauer | |
| 10,948,198 | B2 | 3/2021 | Könneker | |
| 11,193,675 | B2 | 12/2021 | Neunhäuserer et al. | |
| 11,614,239 | B2 | 3/2023 | Goessler et al. | |
| 2007/0062514 | A1 | 3/2007 | Ota | |
| 2019/0186758 | A1 * | 6/2019 | Heppi | F24C 15/2042 |
| 2020/0191409 | A1 * | 6/2020 | Scott | F24C 15/2021 |
| 2020/0318835 | A1 | 10/2020 | Bruckbauer | |

FOREIGN PATENT DOCUMENTS

| | | | | |
|---|---|---|---|---|
| EP | 3 268 670 | B1 | 11/2019 | |
| EP | 3 390 918 | B1 | 3/2020 | |
| EP | 3 491 296 | B1 | 3/2020 | |
| EP | 3 620 721 | B1 | 10/2020 | |
| EP | 3 133 350 | B1 | 11/2020 | |
| EP | 3 593 053 | B1 | 11/2020 | |
| EP | 3 505 830 | B1 | 3/2021 | |
| EP | 3 869 107 | B1 | 2/2022 | |
| JP | 2002-85262 | A | 3/2002 | |
| JP | 3969466 | | 6/2007 | |
| JP | 2020-536212 | A | 12/2020 | |
| KR | 100936154 | B1 * | 1/2010 | F24C 5/2042 |
| KR | 10-1207165 | | 11/2012 | |
| KR | 10-2019-0020685 | | 3/2019 | |
| WO | WO 2017/029128 | A1 | 2/2017 | |
| WO | WO 2018/036799 | A1 | 3/2018 | |

OTHER PUBLICATIONS

Korean to English machine translation of KR1020110121326.*
Proremodeler, 4 Rules for Flexible Ducts that Remodelers Need to Know, 8 pages, https://www.proremodeler.com/home/article/55184075/4-rules-for-flexible-ducts-that-remodelers-need-to-know (Year: 2019).*
Korean to English machine translation of KR-100936154-B1.*
International Search Report dated Oct. 6, 2023 in International Patent Application No. PCT/KR2023/008171.
Written Opinion of the International Searching Authority dated Oct. 6, 2023 in International Patent Application No. PCT/KR2023/008171.
Korean Office Action dated Aug. 27, 2026 for Korean Application No. 10-2022-0115946.

* cited by examiner

COOKING APPARATUS

CROSS-REFERENCE TO RELATED APPLICATIONS

This application is a continuation application under 35 U.S.C. § 111(a) of international Application No. PCT/KR2023/008171, filed on Jun. 14, 2023, which claims priority to Korean Patent Application No. 10-2022-0115946, filed on Sep. 14, 2022, the disclosures of which are incorporated by reference herein in their entireties.

BACKGROUND

1. Field

The disclosure relates to a cooking apparatus, and more particularly, to a cooking apparatus including a cooktop and a hood.

2. Description of Related Art

A cooking apparatus is a device for heating and cooking a cooking object such as food, and refers to a device capable of providing various functions related to cooking, such as heating, defrosting, drying, and sterilizing a cooking object. The cooking apparatus may include a cooktop that heats a cooking vessel containing food using electricity or gas.

In the case of a cooktop, contaminants such as oil mist, non-combustible gas, and odor are generated during a cooking process. Accordingly, a hood may be installed above the cooktop to discharge air containing the contaminants to the outside.

SUMMARY

Aspects of embodiments of the disclosure will be set forth in part in the description which follows and, in part, will be apparent from the description, or may be learned by practice of the presented embodiments.

According to an embodiment of the disclosure, a cooktop including an upper plate on which to place a cooking vessel, and a suction port penetrating through the upper plate in a first direction; a duct a chamber to connect the suction port and the duct; and a blower fan connected to the duct to generate airflow so that air around the upper plate is suctioned through the suction port and then through the chamber and then guided by the duct. The chamber may include a chamber body including a chamber outlet arranged in a second direction perpendicular to the first direction from the suction port and configured to communicate with the duct, and an inner space formed so that air suctioned through the suction port flows through the inner space to the chamber outlet, and a guide rib arranged inside the chamber body to partition the inner space to guide the air suctioned through the suction port to the chamber outlet.

According to an embodiment of the disclosure, the guide rib may include a partition rib extending upward toward the suction port, and extending in the second direction so as to be directed to the chamber outlet.

According to an embodiment of the disclosure, the partition rib may include a first partition rib, and a second partition rib spaced apart from the first partition rib with respect to a third direction perpendicular to the second direction, so as to partition the inner space.

According to an embodiment of the disclosure, the first partition rib and the second partition rib may each have a curved surface.

According to an embodiment of the disclosure, the partition rib may further include a third partition rib arranged between the first partition rib and the second partition rib. The third partition rib may extend in a straight line toward a center of the chamber outlet.

According to an embodiment of the disclosure, the first partition rib may be disposed to correspond to a first side of the suction port with respect to the third direction, the second partition rib may be disposed to correspond to a second side of the suction port, opposite the first side of the suction port, with respect to the third direction, and the third partition rib may be disposed to correspond to a first side of the suction port with respect to the second direction, the first side of the suction port with respect to the second direction being adjacent to the chamber outlet.

According to an embodiment of the disclosure, the chamber body may further include a bottom surface, and a sidewall extending upward from the bottom surface to form the inner space.

According to an embodiment of the disclosure, the sidewall may include a first sidewall disposed to face the chamber outlet with respect to the second direction, a second sidewall extending between the first sidewall and the chamber outlet, and a third sidewall extending between the first sidewall and the chamber outlet and disposed to face the second sidewall. The guide rib may include a protruding rib extending from the first sidewall toward the chamber outlet.

According to an embodiment of the disclosure, the protruding rib may extend from a center of the first sidewall toward a center of the chamber outlet.

According to an embodiment of the disclosure, the second sidewall and the third sidewall may each have a curved surface extending toward the second direction.

According to an embodiment of the disclosure, the cooktop may further include a lower plate disposed under the upper plate and arranged to be in contact with the chamber body so as to cover a portion of the inner space of the chamber. The guide rib may protrude upward from a bottom surface of the chamber body so as to partially contact with the lower plate.

According to an embodiment of the disclosure, the blower an may be offset in the second direction from the suction port.

According to an embodiment of the disclosure, the blower fan may be offset in the first direction from the chamber outlet.

According to an embodiment of the disclosure, the chamber may further include a locking protrusion protruding upward from a bottom surface of the chamber body so as to be adjacent to the chamber outlet.

According to an embodiment of the disclosure, the cooking apparatus may further include a filter mounted to the suction port; and a tray inside the chamber body below the filter.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
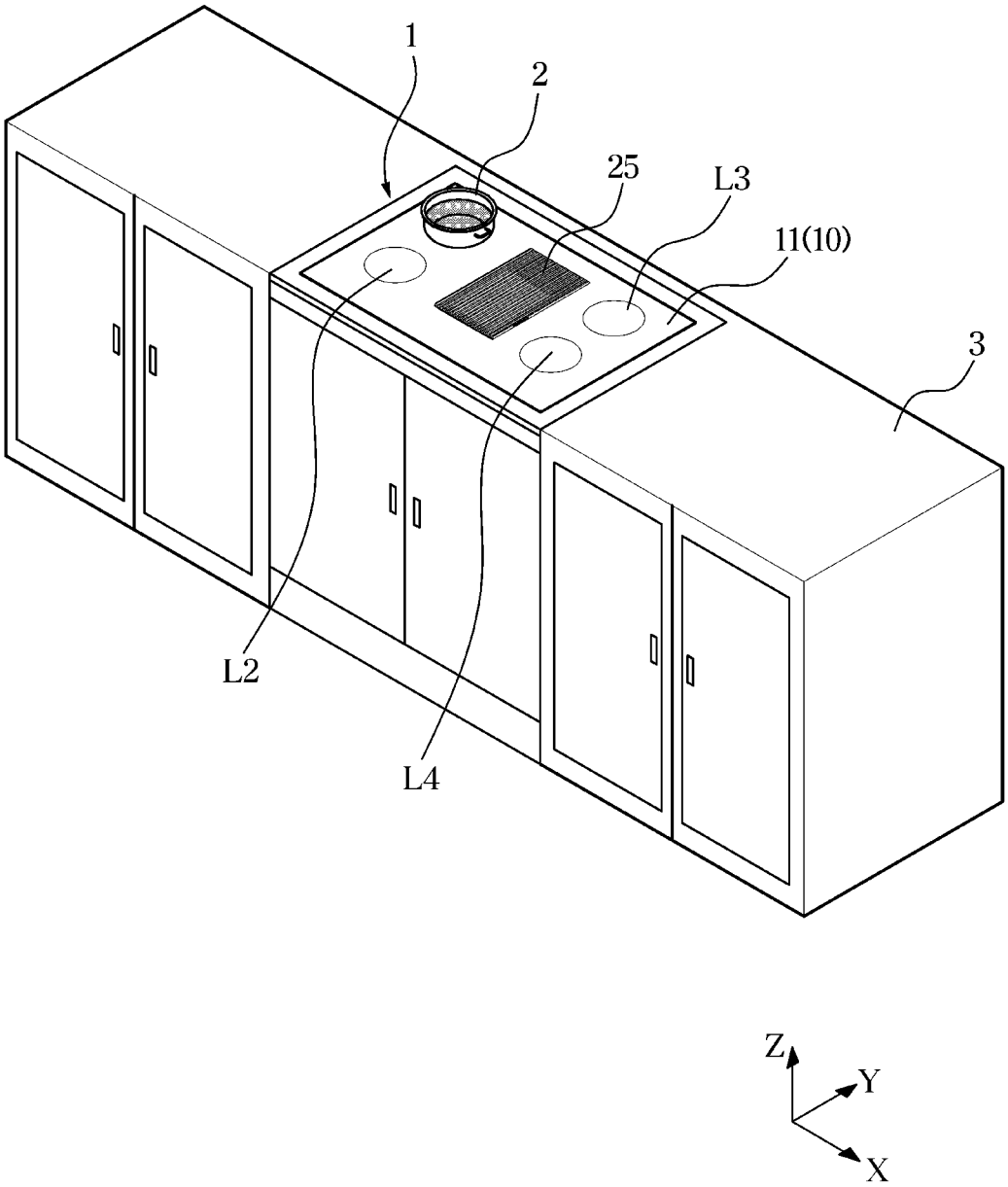
FIG. 1 is a perspective view illustrating a state in which a cooking apparatus according to an embodiment of the disclosure is installed.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front portion", "upper portion", "lower portion", "left side", "right side" and the like may be defined by the drawings, but the shape and the location of the component is not limited by the term.

Embodiments of the disclosure may provide a cooking apparatus including a cooktop and a hood integrally formed with each other. Embodiments of the disclosure may provide a cooking apparatus capable of reducing noise generated when air is introduced into a hood.

Figure 2:
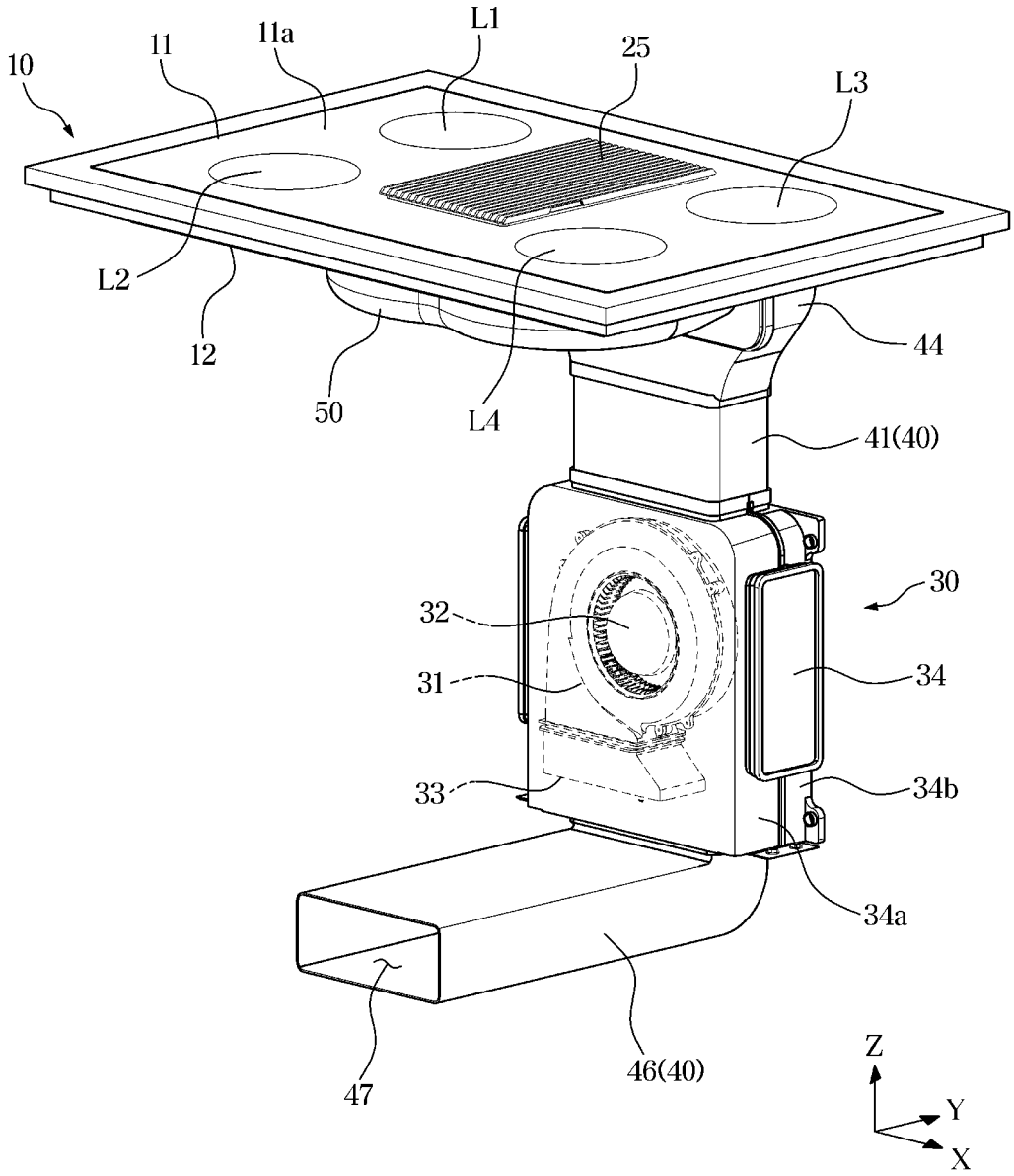
FIG. 2 is a perspective view of the cooking apparatus according to an embodiment of the disclosure.

For convenience of description, as shown in FIG. 2, a direction in which a blower fan 31 is shown with respect to a chamber 50 in a cooking apparatus 1 is defined as "rear side", and a direction in which a cooktop 10 is shown with respect to a hood 30 in the cooking apparatus 1 is defined as "upper side".

Reference will now be made in detail to embodiments of the disclosure, examples of which are illustrated in the accompanying drawings.

Figure 3:
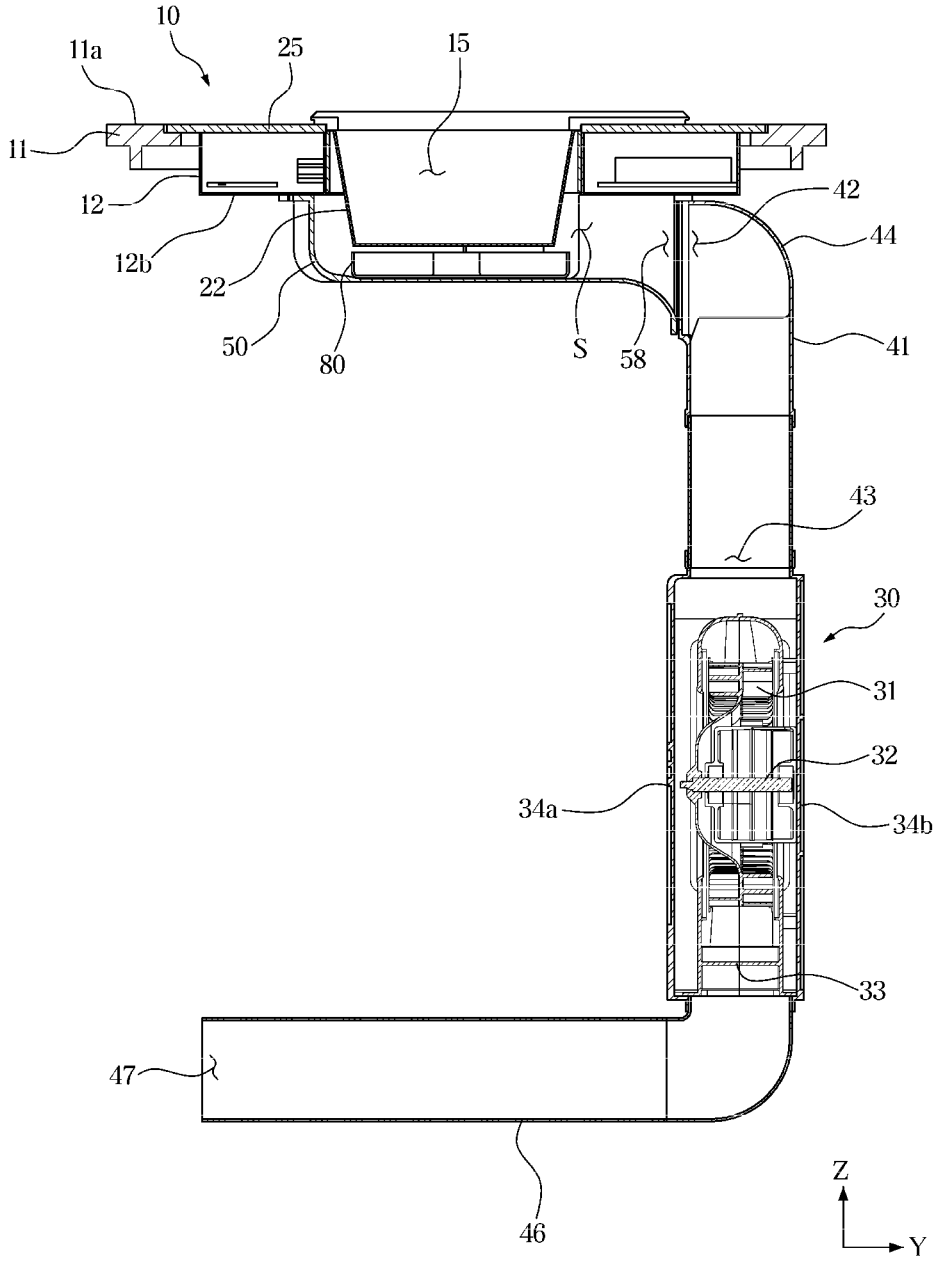
FIG. 3 is a cross-sectional view of the cooking apparatus according to an embodiment of the disclosure.

FIG. 1 is a perspective view illustrating a state in which a cooking apparatus according to an embodiment of the disclosure is installed. FIG. 2 is a perspective view of the cooking apparatus according to an embodiment of the disclosure. FIG. 3 is a cross-sectional view of the cooking apparatus according to an embodiment of the disclosure.

The cooking apparatus 1 may be disposed indoors. For example, the cooking apparatus 1 may be disposed in a kitchen and may be coupled to and installed in a cabinet 3.

The cooking apparatus 1 may be configured to cook food. The cooking apparatus 1 may include the cooktop 10 configured to cook food and the hood 30 configured to suction air containing contaminants generated in a process of cooking food. The cooking apparatus 1 may be a hood-integrated cooktop in which the hood 30 is provided under the cooktop 10.

The cooktop 10 may be an induction cooktop, that is an electric cooktop. The cooktop 10 may include a plurality of coils (not shown) corresponding to positions L1, L2, L3, and L4 in which a cooking vessel may be placed. A current in which a magnitude thereof changes over time may be applied to the coil. As the current is applied to the coil, a magnetic field may be formed around the coil. As the current applied to the coil changes, the magnetic field formed around the coil may also change. An eddy current according to a change in the magnetic field may flow on a surface of a cooking vessel 2 that is in contact with an upper plate 11, thereby heating the cooking vessel.

In the drawings, it is illustrated that the cooktop 10 is an induction cooktop, that is an electric cooktop, but the disclosure is not limited thereto. The type of cooktop 10 may not be limited thereto. For example, the cooktop 10 may be a radiant cooktop among electric cooktops.

By using a method in which the current flows using a magnetic field, the induction cooktop may directly heat a cooking vessel without heating the upper plate. Accordingly, the risk of burns may be reduced. However, only a cooking vessel formed of a metal to which a magnet is attached may be used as a cooking vessel, but glass, ceramics, or aluminum may not be used. By using a method in which electricity flows through a nichrome wire under a ceramic plate, the radiant cooktop may heat an upper plate and a cooking vessel. Accordingly, the upper plate may be heated and thus there is the risk of burns. However, as long as a bottom is flat, all cooking vessels may be used for the radiant cooktop, except for direct-fired cooking vessel. The cooktop 10 may also be a hybrid capable of using both the magnetic field and the radiant heat. The hybrid may be a product that has the advantages of both induction cooktop and radiant cooktop.

The cooktop 10 may be a gas cooktop in addition to an electric cooktop. For example, the cooktop 10 may be a gas stove. However, in this drawing, an induction cooktop, which is an electric cooktop, will be described as an example.

The hood 30 may be configured to discharge air containing contaminants generated from the cooktop 10 to the outside. Alternatively, the hood 30 may allow air containing contaminants to pass through a deodorization filter (not shown) and then circulate the filtered air back to the inside. However, in this drawing, it is illustrated that the hood 30 includes a duct 40 configured to discharge air to the outside.

The cooking apparatus 1 may be a hood-integrated cooktop in which the cooktop 10 and the hood 30 are combined. The hood 30 may be coupled to a lower part of the cooktop 10. However, the disclosure is not limited thereto, and the cooktop 10 and the hood 30 may be integrally formed with each other.

Because the hood 30 is disposed below the cooktop 10, an upper space of a place in which the cooking apparatus 1 is installed may be secured. In addition, because the hood 30 is disposed at the rear of the cooktop 10, it is possible to secure a front space. For example, referring to FIG. 1, an upper part of the cooking apparatus 1 is an empty space, and thus it is possible to improve aesthetics. Further, a storage space of the cabinet 3 is provided in front of the cooking apparatus 1 and thus it is possible to improve convenience.

That is, the cooking apparatus 1 is a hood-integrated cooktop, and space utilization may be improved.

Referring to FIG. 3, the cooktop 10 may include a suction port 15. The suction port 15 may be formed in a first direction Z to penetrate the cooktop 10. The suction port 15 may be opened in the first direction Z. A description of the first direction Z will be described later.

Air containing contaminants around the cooktop 10 may be sucked into the suction port 15 by a suction force of the blower fan 31. The air sucked into the suction port 15 may be moved to the duct 40 through the chamber 50 and discharged to the outside.

The blower fan 31 may be disposed toward a second direction Y from the suction port 15. The blower fan 31 may be biased toward the second direction Y from the center of the suction port 15. Description of the second direction Y will be described later. The blower fan 31 may be disposed behind the suction port 15.

Figure 4:
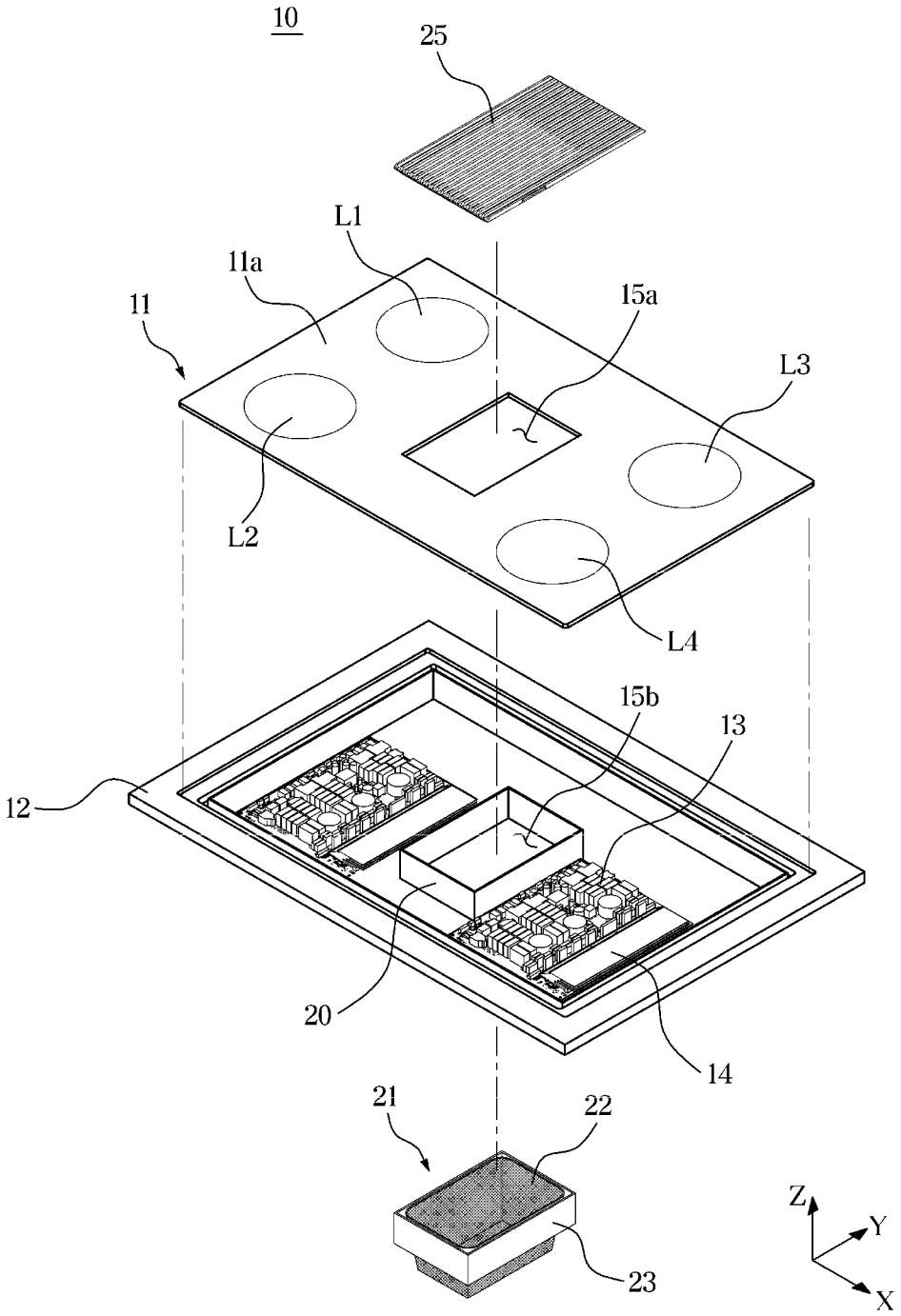
FIG. 4 is an exploded perspective view of a cooktop of the cooking apparatus according to an embodiment of the disclosure.

FIG. 4 is an exploded perspective view of a cooktop of the cooking apparatus according to an embodiment of the disclosure.

The cooktop 10 may include the upper plate 11 on which a cooking vessel 2 is placed, and a lower plate 12 provided under the upper plate 11. The cooking vessel 2 may be placed on an upper surface 11*a* of the upper plate 11. The cooking vessel 2 may be placed at various positions L1, L2, L3, and L4 of the upper plate 11.

The upper plate 11 may have a substantially rectangular shape. However, the disclosure is not limited thereto, and the upper plate 11 may be provided in other shapes.

The lower plate 12 may be coupled to the upper plate 11 to receive internal components. The lower plate 12 may include a receiving space. An electric component 13, a heat sink 14, and the like may be provided in the receiving space. When the cooktop 10 is operated, heat may be generated in the electric component 13, and the heat sink 14 may dissipate the heat.

The lower plate 12 may have a substantially rectangular shape. However, the disclosure is not limited thereto, and the lower plate 12 may be provided in other shapes.

The cooktop 10 may include the suction port 15. The suction port 15 may be provided to suction air around the cooktop 10. The suction port 15 may communicate with the chamber 50 to be described below. Air may flow into the hood 30 through the suction port 15.

The suction port 15 may be formed to penetrate the cooktop 10. Suction ports 15*a* and 15*b* may be formed on the upper plate 11 and/or the lower plate 12. The suction port 15 may formed on the upper plate 11 and the lower plate 12 corresponding to the upper plate 11, so as to allow air to pass through the upper plate 11 and the lower plate 12 of the cooktop 10 and to flow into the hood 30. The suction port 15 may be formed to penetrate from the upper surface 11*a* of the upper plate 11 to a lower surface 12*b* of the lower plate 12.

The suction port 15 may be formed in the first direction Z. The first direction Z may be a direction penetrating the upper plate 11 and the lower plate 12. The first direction Z may be a direction along the Z-axis. The first direction Z may be a vertical direction.

The lower plate 12 may include a protrusion 20 provided around the suction port 15. The protrusion 20 may be provided to protrude from the lower plate 12 toward the upper plate 11 along a circumference of the suction port 15. The protrusion 20 may protrude in the first direction Z.

The protrusion 20 may include a plate. The protrusion 20 may be in contact with a lower surface of the upper plate 11. The protrusion 20 may guide air, which is introduced through the suction port 15*a* of the upper plate 11, to be moved to the suction port 15*b* of the lower plate 12. Due to the protrusion 20, the air may flow into the chamber 50 without loss of flow rate.

The suction port 15 may be formed approximately at the center of the cooktop 10 to evenly suction air around the upper plate 11. For example, even when the cooking vessel 2 is placed in any of a first position L1, a second position L2, a third position L3, and a fourth position L4, the suction port 15 may be formed to suction air evenly.

The suction port 15 may have a substantially rectangular shape. However, the disclosure is not limited thereto and the suction port 15 may be formed in various shapes such as a circle.

The cooktop 10 may include a suction grille 25 provided to prevent foreign substances from entering the suction port 15. The suction grille 25 may be mounted on the upper plate 11 to cover the suction port 15.

The suction grille 25 may have a shape corresponding to the shape of the suction port 15. The suction grille 25 may have a substantially rectangular shape. However, the disclosure is not limited thereto, and the suction grille 25 may be formed in various shapes.

The cooking apparatus 1 may include a filter unit 21 mounted on the suction port 15 of the cooktop 10. The filter unit 21 may be provided to filter out contaminants. The filter unit 21 may be detachably mounted to the suction port 15.

The filter unit 21 may include a filter 22 and a filter bracket 23 for mounting the filter 22 to the suction port 15. The filter 22 may be removed from the suction port 15 for cleaning.

The filter 22 may be a grease filter for removing grease. The filter 22 may have a cross section that is substantially a U-shape. The filter 22 may cover between the suction port 15 and the chamber 50 to filter out contaminants sucked into the suction port 15. The filter 22 may include fine holes through which air excluding grease passes.

In this drawing, it is illustrated that the filter 22 has a substantially rectangular parallelepiped shape, but the disclosure is not limited thereto. For example, the filter 22 may be provided in the form of a U-shaped container.

The filter bracket 23 may be provided to surround an upper periphery of the filter 22. The filter bracket 23 may be mounted on the suction port 15 by a locking protrusion (not shown) formed inside the suction port 15. When the filter bracket 23 is mounted inside the suction port, the filter bracket 23 may be disposed lower than a height of the upper plate 11 and placed inside the suction port 15.

An upper portion of the filter bracket 23 may support the suction grille 25 covering the suction port 15. The filter bracket 23 may be provided in a shape corresponding to the shape of the suction port 15. However, the filter unit 21 may be omitted.

Figure 5:
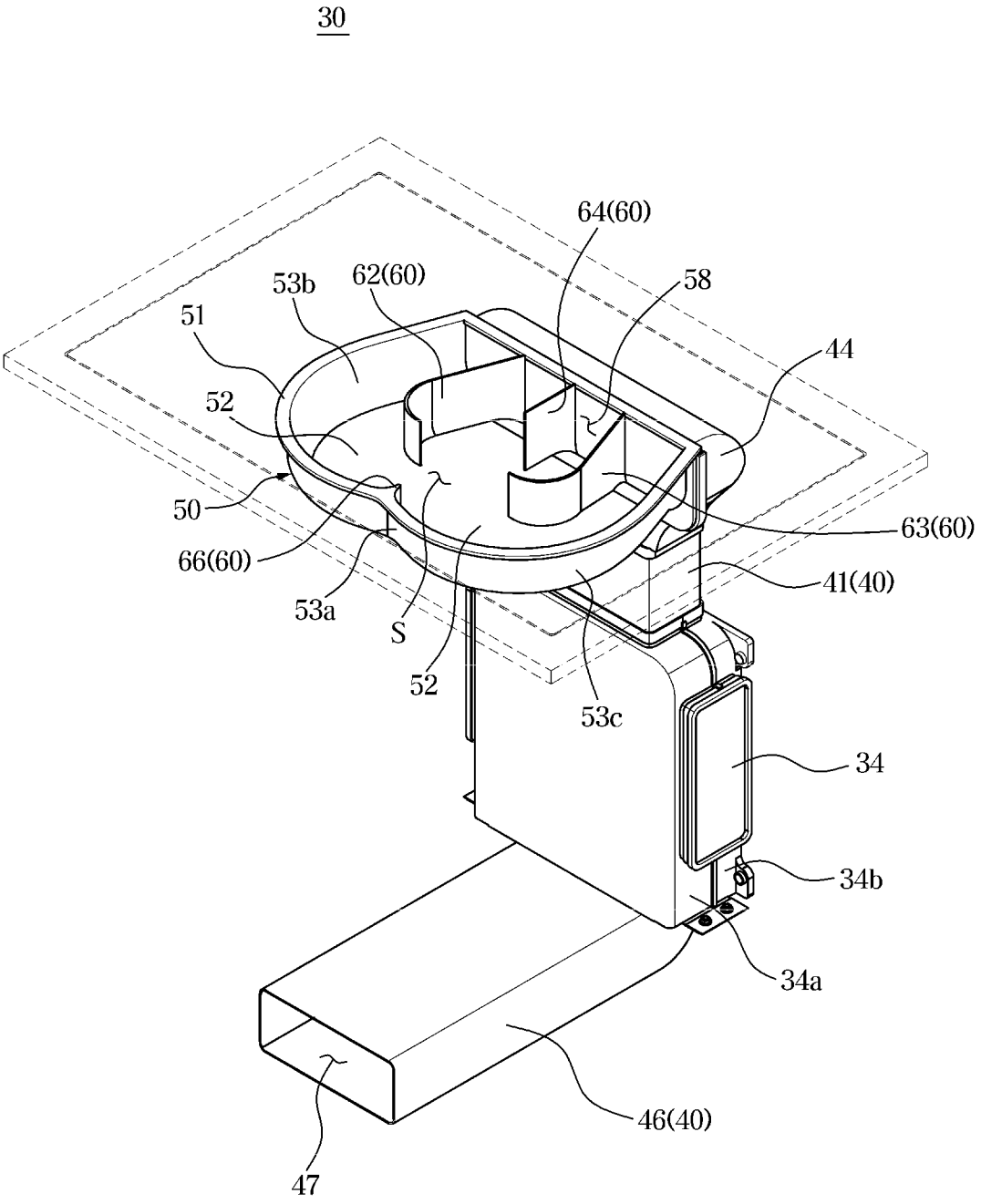
FIG. 5 is a perspective view illustrating a hood of the cooking apparatus according to an embodiment of the disclosure.
Figure 6:
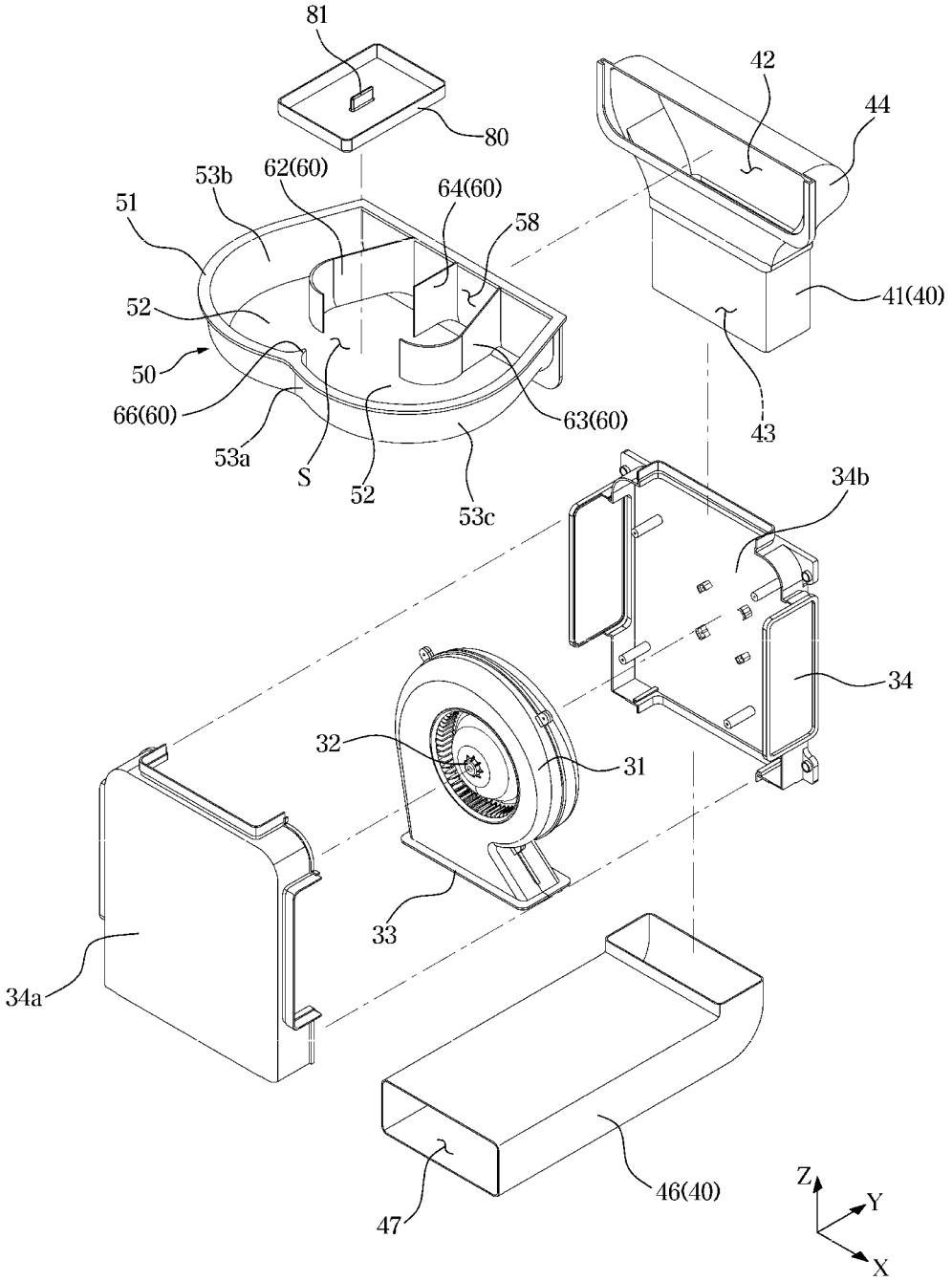
FIG. 6 is an exploded perspective view of the hood of the cooking apparatus according to an embodiment of the disclosure.

FIG. 5 is a perspective view illustrating a hood of the cooking apparatus according to an embodiment of the disclosure. FIG. 6 is an exploded perspective view of the hood of the cooking apparatus according to an embodiment of the disclosure.

The hood 30 may include the duct 40. The duct 40 may be provided to discharge air sucked through the suction port 15 to the outside of the hood 30.

The duct 40 may include a first duct 41 and a second duct 46. The blower fan 31 may be disposed between the first duct 41 and the second duct 46. The first duct 41 may connect the chamber 50 and the blower fan 31. The second duct 46 may be provided to discharge air discharged from the blower fan 31 to the outside.

The duct 40 may include a duct inlet 42 through which air sucked from the suction port 15 is introduced, and a duct outlet 47 through which the air is discharged to the outside. The duct inlet 42 may be provided in the first duct 41. The duct outlet 47 may be provided in the second duct 46.

The first duct 41 may connect the chamber 50 and a blower fan case 34. The duct inlet 42 of the first duct 41 may be connected to a chamber outlet 58 of the chamber 50. The duct inlet 42 may be formed to correspond to the chamber outlet 58.

The first duct 41 may be disposed toward the second direction Y from the chamber 50. The first duct 41 may be disposed at the rear of the chamber 50.

The first duct 41 may include a first duct outlet 43 connected to the blower fan 31. The first duct outlet 43 may be provided to allow the air inside the first duct 41 to flow to the blower fan 31.

The first duct 41 may extend from the duct inlet 42 to the first duct outlet 43. The first duct 41 may include an elbow 44 connecting the duct inlet 42 and the first duct outlet 43. The elbow 44 may be formed by being bent. The elbow 44 may be formed at right angles. At least a part of the elbow 44 may be formed in a curved surface. Because the elbow 44 is formed in a curved surface, a flow resistance of the air introduced into the duct inlet 42 may be reduced.

The first duct 41 may be connected to the blower fan case 34. The blower fan case 34 may serve as a kind of duct connecting the first duct 41 and the second duct 46.

The blower fan 31 may be disposed inside the blower fan case 34. The blower fan case 34 may be provided to receive the blower fan 31.

The blower fan case 34 may include a front blower fan case 34*a* and a rear blower fan case 34*b*.

The blower fan 31 may be configured to move air. The blower fan 31 may generate a suction force to allow air to be introduced through the suction port 15. The blower fan 31 may be a blower fan.

A blower fan motor 32 may be arranged at a rotation axis of the blower fan 31. The blower fan 31 may be rotated around the rotation axis by the blower fan motor 32. The blower fan 31 may include a blower fan outlet 33 to discharge the sucked air. The blower fan outlet 33 may be formed in a direction perpendicular to the rotation axis.

The blower fan 31 may be disposed below the chamber 50. The blower fan 31 may be disposed toward the first direction Z from the chamber outlet 58. Accordingly, the air sucked through the suction port 15 may be moved downward by the suction force of the blower fan 31.

The duct 40 may include the second duct 46. The second duct 46 may be connected to the blower fan case 34. The second duct 46 may be provided to discharge air, which moves through the first duct 41 and the blower fan case 34, to the outside. The second duct 46 may include the duct outlet 47 through which air is discharged to the outside.

Figure 7:
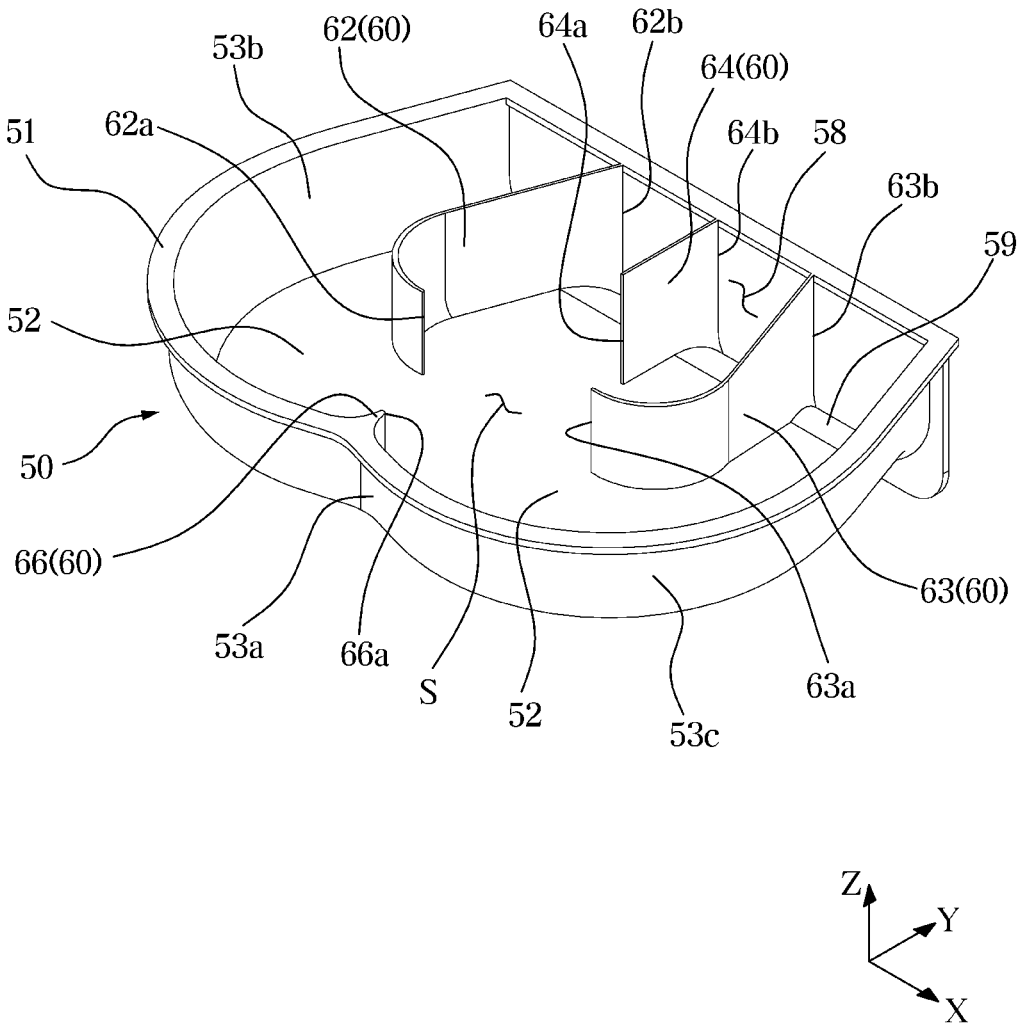
FIG. 7 is an enlarged perspective view of a chamber of the cooking apparatus according to an embodiment of the disclosure.
Figure 8:
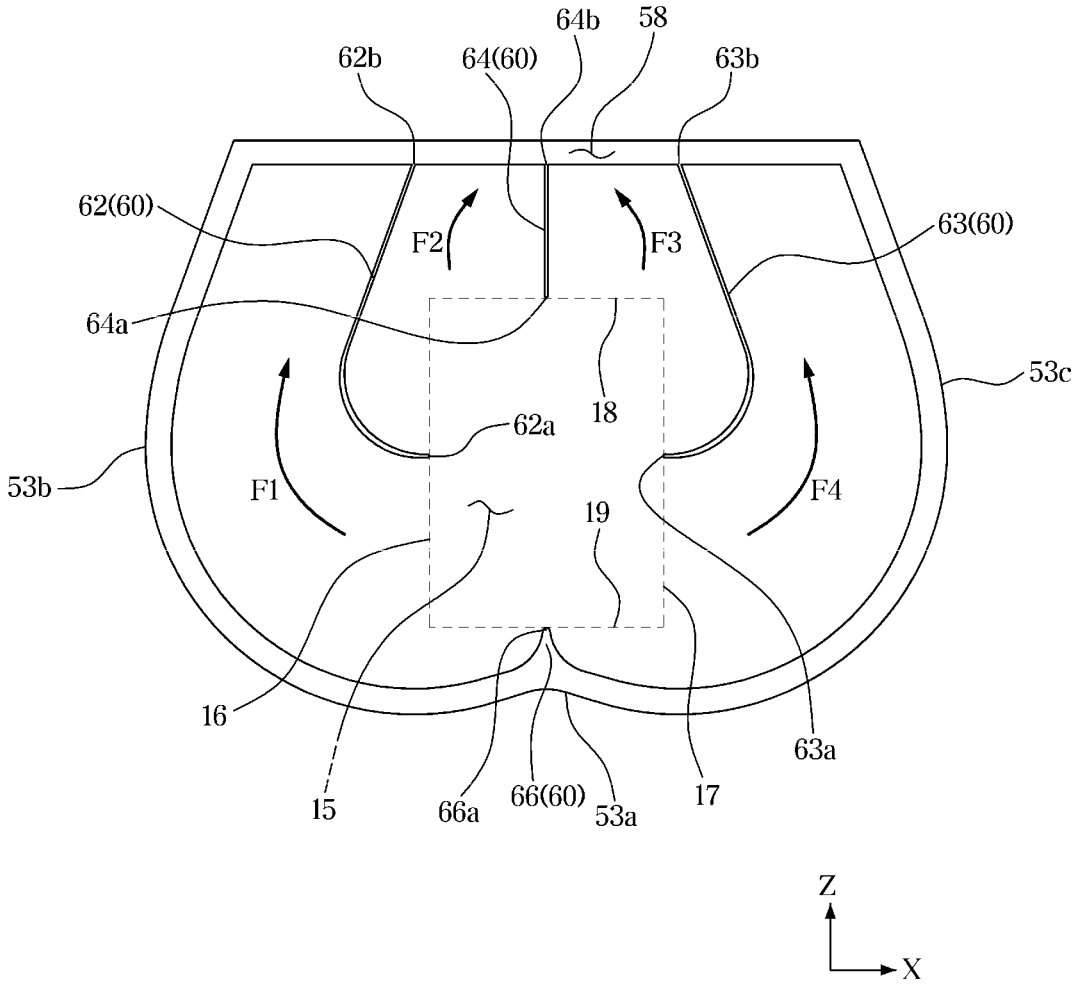
FIG. 8 is a front view illustrating a state in which air flows inside the chamber of the cooking apparatus according to an embodiment of the disclosure.

FIG. 7 is an enlarged perspective view of a chamber of the cooking apparatus according to an embodiment of the disclosure.

The hood 30 may include the chamber 50. The chamber 50 may be provided to connect the cooktop 10 and the duct 40. The chamber 50 may connect the lower plate 12 and the first duct 41. The chamber 50 may be provided to allow the air sucked through the suction port 15 to be moved to the duct 40.

The chamber 50 may include a flow path through which air moves. The chamber 50 may function as a part of the duct.

The chamber 50 may include a chamber body 51. The chamber body 51 may include a bottom surface 52. The bottom surface 52 may include a plate shape.

The chamber body 51 may include a sidewall 53 extending from the bottom surface 52 toward the first direction Z. The sidewall 53 may extend toward the cooktop 10. The sidewall 53 may be provided to be in contact with the lower plate 12 of the cooktop 10.

The sidewall 53 may include a first sidewall 53*a* disposed to face the chamber outlet 58, and a second sidewall 53*b* and a third sidewall 53*c* extending from the first sidewall 53*a* toward the chamber outlet 58. The second sidewall 53*b* and the third sidewall 53*c* may be disposed to face each other. The first sidewall 53*a* may be disposed between the second sidewall 53*b* and the third sidewall 53*c*.

The chamber body 51 may include an inner space S. The inner space S may be a space formed by the bottom surface 52 and the sidewall 53. The inner space S may be a space formed between the suction port 15 and the chamber outlet 58.

The inner space S may be a space provided to allow air to be moved. Air sucked through the suction port 15 may be moved to the duct 40 through the inner space S of the chamber 50. A flow path may be formed in the inner space S.

The chamber 50 may be disposed under the cooktop 10. The chamber body 51 may be provided to be in contact with the lower surface 12*b* of the lower plate 12.

An upper portion of the chamber body 51 may be open. The chamber body 51 may include an opening disposed toward the cooktop 10. The opening may be provided in the upper portion of the chamber body 51.

The opening of the chamber body 51 may be larger than the suction port 15 of the cooktop 10. A portion of the opening of the chamber body 51 may correspond to the suction port 15, and the remaining portion thereof may be covered by the lower surface 12*b* of the lower plate 12. Accordingly, air passing through the suction port 15 may be introduced into the chamber 50 through a portion of the opening of the chamber body 51 corresponding to the suction port 15.

The chamber body 51 may include the chamber outlet 58. The chamber outlet 58 may discharge air, which is introduced into the chamber 50, to the duct 40. The chamber outlet 58 may be connected to the duct inlet 42.

The chamber outlet 58 may be formed on one side of the chamber body 51. The chamber outlet 58 may be disposed toward the second direction Y from the suction port 15. The second direction Y may be a direction perpendicular to the first direction Z. The second direction Y may be a direction along the Y-axis. The second direction Y may be the front and rear direction. The second direction Y may be a direction in which the blower fan 31 is disposed.

The chamber outlet 58 may be disposed behind the suction port 15. The chamber outlet 58 may be disposed between the suction port 15 and the blower fan 31. The chamber outlet 58 may be disposed toward the blower fan 31.

The chamber outlet 58 may be formed in a substantially rectangular shape. The chamber outlet 58 may be formed to correspond to the duct inlet 42. The chamber outlet 58 may extend along the left and right direction.

A filter (not shown) may be arranged in the chamber outlet 58. The filter (not shown) may filter out contaminants present in the air introduced into the chamber 50. The filter (not shown) may be provided to correspond to the shape of the chamber outlet 58.

The cooking apparatus 1 may include a tray 80. The tray 80 may receive foreign substances such as powder, crumbs, and water generated during the cooking. The tray 80 may be disposed under the filter unit 21 to be spaced apart from the filter unit 21. The tray 80 may be disposed inside the chamber 50.

The tray 80 may be withdrawn through the suction port 15 when a user replaces or cleans the tray 80. The tray 80 may include a handle 81 provided to allow a user to easily withdraw the tray 80. The handle 81 may protrude from an approximate center of the tray 80.

The tray 80 may be formed in a smaller size than the suction port 15 to be withdrawn through the suction port 15. In this drawing, it is illustrated that the tray 80 has a substantially rectangular shape, but the disclosure is not limited thereto. For example, the tray 80 may be provided in various shapes, such as a circular shape and an oval shape, as long as the tray 80 is provided to be withdrawn through the suction port 15. However, the tray 80 may be omitted.

The chamber 50 may collect dust and the like that are not collected in the tray 80 during the movement of contaminants. Because the chamber 50 is formed to be larger than the tray 80, the chamber 50 may assist the tray 80 to collect foreign substances.

The chamber 50 may include a recess (not shown) provided to mount the tray 80 thereon. The recess (not shown) may be provided on the bottom surface 52 of the chamber body 51. The recess (not shown) may be formed by being depressed from the bottom surface 52.

The recess (not shown) may be provided to correspond to the shape of the tray 80. The recess (not shown) may have a substantially rectangular shape.

The recess (not shown) may prevent the tray 80 from being out of position. The recess (not shown) may guide the position of the tray 80 when a user cleans or replaces the tray 80. However, the recess (not shown) may be omitted.

The chamber 50 may include a locking protrusion 59. The locking protrusion 59 may protrude from the bottom surface of the chamber body 51. The locking protrusion 59 may extend toward the first direction Z. The locking protrusion 59 may be disposed adjacent to the chamber outlet 58. The locking protrusion 59 may be provided in front of the chamber outlet 58.

The locking protrusion 59 may be provided to prevent foreign substances inside the chamber 50 from being discharged to the duct 40 through the chamber outlet 58.

The chamber 50 may include a guide rib 60. The guide rib 60 may be provided inside the chamber body 51. The guide rib 60 may be provided in the inner space S of the chamber 50. The guide rib 60 may be provided in the flow path through which air moves.

The guide rib 60 may be provided to guide the flow of air. The guide rib 60 may guide air, which is sucked through the suction port 15, to flow to the chamber outlet 58. The guide rib 60 may guide air inside the chamber 50 to be moved to the blower fan 31.

The guide rib 60 may extend toward the second direction Y. The guide rib 60 may extend toward the chamber outlet 58. The guide rib 60 may extend toward the blower fan 31. The guide rib 60 may be provided to move air toward the chamber outlet 58. Air may be easily moved to the chamber outlet 58 along the extension direction of the guide rib 60.

The guide rib 60 may include partition ribs 62, 63, and 64. The partition ribs 62, 63, and 64 may extend between the suction port 15 and the chamber outlet 58.

First ends 62*a*, 63*a*, and 64*a* of the partition ribs 62, 63*a*, and 64 may be disposed at the suction port 15, and second ends 62*b*, 63*b*, and 64*b* located opposite to the first ends 62*a*, 63*a*, and 64*a* may be disposed at the chamber outlet 58. Air introduced through the suction port 15 may be moved to the chamber outlet 58 along the partition ribs 62, 63, and 64.

The partition ribs 62, 63, and 64 may include a first partition rib 62 and a second partition rib 63 spaced apart from the first partition rib 62. The second partition rib 63 may be spaced apart from the first partition rib 62 with respect to the third direction X.

The third direction X may be a direction perpendicular to the first direction Z and/or the second direction Y. The third direction X may be a direction along the X-axis. The third direction X may be the left and right direction.

The second partition rib 63 may be spaced apart from the first partition rib 62 to partition the inner space S of the chamber 50.

The suction port 15 may include one end 18 adjacent to the chamber outlet with respect to the second direction Y and the other end 19 opposite the one end 18. The suction port 15 may include one end 16 and the other end 17 located opposite to the one end 16 with respect to the third direction X.

Particularly, the suction port 15 may have a substantially rectangular shape. The suction port 15 may include a first side 16 and a second side 17 facing the first side 16.

The first partition rib 62 may extend from the first side 16 of the suction port 15 to the chamber outlet 58. The first end 62*a* of the first partition rib 62 may be disposed to correspond to the first side 16 of the suction port 15, and the second end 62*b* located opposite to the first end 62*a* may be disposed at the chamber outlet 58.

The second partition rib 63 may extend from the second side 17 of the suction port 15 to the chamber outlet 58. The first end 63*a* of the second partition rib 63 may be disposed to correspond to the second side 17 of the suction port 15, and the second end 63*b* located opposite to the first end 63*a* may be disposed at the chamber outlet 58.

The first end 62*a* of the first partition rib 62 and the first end 63*a* of the second partition rib 63 may be disposed to face each other.

The first partition rib 62 may be disposed adjacent to the second sidewall 53*b*. The second partition rib 63 may be disposed adjacent to the third sidewall 53*c*.

The partition ribs 62, 63, and 64 may include a third partition rib 64 disposed between the first partition rib 62 and the second partition rib 63. The third partition rib 64 may be spaced apart from the first partition rib 62 and/or the second partition rib 63.

The suction port 15 may include the third side 18 connecting the first side 16 and the second side 17. The third side 18 may be a side facing the chamber outlet 58. The third side 18 may be a side adjacent to the chamber outlet 58.

The third partition rib 64 may extend from the third side 18 of the suction port 15 to the chamber outlet 58. The first end 64*a* of the third partition rib 64 may be disposed to correspond to the third side 18 of the suction port 15, and the second end 64*b* located opposite to the first end 64*a* may be disposed at the chamber outlet 58.

The third partition rib 64 may extend along a straight line from the suction port 15 to the chamber outlet 58.

Because the chamber outlet 58 is disposed toward the second direction Y from the suction port 15, the front side of the suction port 15 may have weaker suction power than the rear side. Therefore, when the cooking vessel 2 is placed at the positions L2 and L4 provided in a front portion of the cooktop 10, the air suction power may be lower than when the cooking vessel 2 is placed at the positions L1 and L3 provided in a rear portion of the cooktop 10.

Therefore, a vortex may be generated in the rear portion of the inner space S of the chamber 50, and thus noise may be generated.

At this time, because the guide rib 60 defines a plurality of flow paths inside the chamber 50, the air sucked into the suction port 15 may be moved along the branched flow paths to the chamber outlet 58.

Particularly, the air sucked into the suction port 15 may be moved through a first flow path F1 formed between the first partition rib 62 and the second sidewall 53*b*, or a second flow path F2 formed between the first partition rib 62 and the third partition rib 64, or a third flow path F3 formed between the third partition rib 64 and the second partition rib 63, or a fourth flow path F4 formed between the second partition rib 63 and the third sidewall 53*c*.

Therefore, even when the cooking vessel 2 is placed at any of the various positions L1, L2, L3, and L4 provided on the upper plate 11 of the cooktop 10, the distribution of the flow velocity of the air sucked through the suction port 15 may be uniform.

In addition, it is possible to reduce an intensity of turbulence by reducing the deviation of the flow velocity inside the chamber 50. Air sucked into the chamber 50 through the suction port 15 may be moved uniformly to the chamber outlet 58.

The first partition rib 62 and/or the second partition rib 63 and/or the first sidewall 53*a* and/or the second sidewall 53*b* and/or the third sidewall 53*c* may include a curved surface. Accordingly, the flow resistance of the air moving through the flow path may be reduced.

In addition, a cross-sectional area of the flow paths F1, F2, F3, and F4 may be reduced toward the chamber outlet 58. Therefore, it is possible to gradually increase the flow rate of the air moving through the flow path.

On the other hand, in this drawing, it is illustrated that three partition ribs 62, 63, and 64 are provided, but the disclosure is not limited thereto. For example, two or less of the partition ribs 62, 63, and 64 may be provided or four or more of the partition ribs may be provided.

In addition, in this drawing, it is illustrated that the flow path is branched into four flow paths, but the disclosure is not limited thereto. For example, the flow path may be branched into three or less of flow paths, or branched into five or more of flow paths.

The guide rib 60 may include a protruding rib 66. The protruding rib 66 may protrude toward the inside of the chamber body 51 from the sidewall 53. The protruding rib 66 may extend from the first sidewall 53*a* toward the chamber outlet 58.

The protruding rib 66 may be disposed in a direction opposite to the direction, in which the chamber outlet 58 is disposed, from the suction port 15. As for the inner space S of the chamber 50, an influence of the blower fan 31 may be reduced and a suction force may be reduced as further away from the chamber outlet 58.

Particularly, air sucked through the suction port 15 may be biased toward the rear side of the chamber 50. Therefore, a vortex may be generated in the front portion of the chamber 50, and noise may be generated accordingly.

The protruding rib 66 may be provided to reduce a space area of a portion having weak suction force in the inner space S. The protruding rib 66 may extend from the first sidewall 53*a* toward the second direction Y, thereby reducing an area of the front portion of the inner space S. Therefore, it is possible to reduce noise by preventing generation of vortex.

The protruding rib 66 may extend from the center of the first sidewall 53*a* toward the center of the chamber outlet 58. The protruding rib 66 may be disposed to face the third partition rib 64.

The protruding rib 66 may extend toward the suction port 15 from the first sidewall 53*a*. The suction port 15 may include a fourth side 19 facing the third side 18. The fourth side 19 may be adjacent to the first sidewall 53*a*. A first end of the protruding rib 66 may be disposed on the first sidewall 53*a* and a second end 66*a* may be disposed to correspond to the fourth side 19 of the suction port 15.

The second end 66*a* of the protruding rib 66 may be disposed on the fourth side 19 of the suction port 15 to allow the air introduced into the suction port 15 to be divided into the left side and the right side. The protruding rib 66 may be provided to define the first flow path F1 and the fourth flow path F4. The protruding rib 66 may guide the air sucked into the front of the suction port 15 to be divided into the left side and the right side to prevent the vortex.

The guide rib 60 may be provided to be in contact with the lower plate 12 of the cooktop 10. The guide rib 60 may protrude from the bottom surface 52 of the chamber body 51 toward the first direction Z. The guide rib 60 may be in contact with the lower surface 12*b* of the lower plate 12.

Therefore, the air introduced into the chamber body 51 through the suction port 15 may be branched into the plurality of flow paths F1, F2, F3, and F4 by the guide rib 60, and air branched into each of the flow paths F1, F2, F3, and F4 may be moved toward the chamber outlet 58 without the loss of flow rate or without mixing with each other.

As is apparent from the above description, it is possible to improve utilization of space of a cooking apparatus.

Further, it is possible to reduce noise of a cooking apparatus.

Embodiments of the disclosure may provide a cooking apparatus including a cooktop including an upper plate on which a cooking vessel is placed, and a suction port formed on the upper plate so as to suction air around the upper plate, a duct provided to guide air suctioned through the suction port, a blower fan connected to the duct to generate airflow, and a chamber provided to connect the suction port and the duct. The chamber may include a chamber body. The chamber body may include a chamber outlet provided to allow aft to be moved to the duct. The chamber body may include a guide rib arranged inside the chamber body and provided to extend toward the chamber outlet so as to guide the airflow.

The guide rib may include a partition rib extending between the suction port and the chamber outlet. The partition rib may include a first partition rib, and a second partition rib spaced apart from the first partition rib so as to partition an inner space of the chamber body.

Embodiments of the disclosure may provide a cooking apparatus including a cooktop including an upper plate on which a cooking vessel is placed, and a suction port opened in a first direction so as to suction air around the upper plate, a duct provided to guide air suctioned through the suction port, a blower fan connected to the duct to generate airflow, and a chamber provided to connect the suction port and the duct. The chamber may include a chamber body including a chamber outlet connected to the duct and arranged in a second direction perpendicular to the first direction from the suction port. The chamber may include a partition rib protruding from a bottom surface of the chamber body toward the first direction and extending from the suction port toward the chamber outlet. The chamber may include a protruding rib extending toward the chamber outlet from a sidewall of the chamber body arranged to face the chamber outlet. The partition rib may include a first partition rib, and a second partition rib spaced apart from the first partition rib so as to partition a flow path inside the chamber.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A cooking apparatus comprising:

a cooktop including:

an upper plate on which to place a cooking vessel, and a suction port penetrating through the upper plate in a first direction;

a duct;

a chamber to connect the suction port and the duct; and a blower fan connected to the duct to generate airflow so that air around the upper plate is suctioned through the suction port and then through the chamber and then guided by the duct, wherein the chamber includes:

a chamber body including:

a chamber outlet arranged in a second direction perpendicular to the first direction from the suction port and configured to communicate with the duct, and an inner space formed so that air suctioned through the suction port flows through the inner space to the chamber outlet, and a guide rib arranged inside the chamber body to partition the inner space to guide the air suctioned through the suction port to the chamber outlet, and including a partition rib extending upward toward the suction port and extending in the second direction so as to be directed to the chamber outlet, wherein the partition rib includes:

a first partition rib, and a second partition rib spaced apart from the first partition rib with respect to a third direction perpendicular to the second direction, so as to partition the inner space, wherein a first end of the first partition rib and a first end of the second partition rib are disposed to face each other, wherein the cooktop further includes:

a lower plate disposed under the upper plate and arranged to be in contact with the chamber body so as to cover a portion of the inner space of the chamber, and wherein the guide rib protrudes upward from a bottom surface of the chamber body so as to partially contact with the lower plate.

2. The cooking apparatus of claim 1, wherein the first partition rib and the second partition rib each have a curved surface.

3. The cooking apparatus of claim 1, wherein the partition rib further includes:

a third partition rib arranged between the first partition rib and the second partition rib, and the third partition rib extends in a straight line toward a center of the chamber outlet.

4. The cooking apparatus of claim 3, wherein the first partition rib is disposed to correspond to a first side of the suction port with respect to the third direction, the second partition rib is disposed to correspond to a second side of the suction port, opposite the first side of the suction port, with respect to the third direction, and the third partition rib is disposed to correspond to a third side of the suction port with respect to the second direction, the third side of the suction port with respect to the second direction being adjacent to the chamber outlet.

5. The cooking apparatus of claim 1, wherein the chamber body further includes:

a sidewall extending upward from the bottom surface to form the inner space.

6. The cooking apparatus of claim 5, wherein the sidewall includes:

a first sidewall disposed to face the chamber outlet with respect to the second direction, a second sidewall extending between the first sidewall and the chamber outlet, and a third sidewall extending between the first sidewall and the chamber outlet and disposed to face the second sidewall, and the guide rib includes a protruding rib extending from the first sidewall toward the chamber outlet.

7. The cooking apparatus of claim 6, wherein the protruding rib extends from a center of the first sidewall toward a center of the chamber outlet.

8. The cooking apparatus of claim 6, wherein the second sidewall and the third sidewall each have a curved surface extending toward the second direction.

9. The cooking apparatus of claim 1, wherein the blower fan is offset in the second direction from the suction port.

10. The cooking apparatus of claim 1, wherein the blower fan is offset in the first direction from the chamber outlet.

11. The cooking apparatus of claim 1, wherein the chamber further includes:

a locking protrusion protruding upward from a bottom surface of the chamber body so as to be adjacent to the chamber outlet.

12. The cooking apparatus of claim 1, further comprising:

a filter mounted to the suction port; and a tray inside the chamber body below the filter.

* * * * *